US006814598B2

(12) United States Patent
Hoffmann et al.

(10) Patent No.: US 6,814,598 B2
(45) Date of Patent: Nov. 9, 2004

(54) ELECTRICAL CONTACT

(75) Inventors: Willi Hoffmann, Lindenfels (DE); Georg Grella, Darmstadt (DE)

(73) Assignee: Tyco Electronics Amp GmbH (DE)

( * ) Notice: Subject to any disclaimer, the term of this patent is extended or adjusted under 35 U.S.C. 154(b) by 0 days.

(21) Appl. No.: 10/374,855

(22) Filed: Feb. 26, 2003

(65) Prior Publication Data

US 2004/0097140 A1 May 20, 2004

(30) Foreign Application Priority Data

Feb. 27, 2002 (DE) ..... 202 03 083 U

(51) Int. Cl.[7] ..... H01R 13/64
(52) U.S. Cl. ..... 439/249; 439/852
(58) Field of Search ..... 439/249–251, 439/246, 853, 852, 857, 856, 81

(56) References Cited

U.S. PATENT DOCUMENTS 4,738,631 A * 4/1988 Takahashi et al. ..... 439/248
5,122,066 A * 6/1992 Plossmer ..... 439/78
6,155,856 A * 12/2000 Sanada ..... 439/246
6,210,240 B1 4/2001 Comerci et al. ..... 439/853
6,491,536 B1 * 12/2002 Torii ..... 439/246
6,511,336 B1 * 1/2003 Turek et al. ..... 439/249

FOREIGN PATENT DOCUMENTS

DE 41 03 423 C2 8/1991

* cited by examiner

*Primary Examiner*—Gary Pauman

(57) ABSTRACT

An electrical contact receives a corresponding contact blade. The electrical contact has contact arms for contacting the contact blade and contact pins for contacting a circuit board. A lateral frame is attached to the contact arms and has a substantially rectangular cross-section. The contact pins are connected to the contact arms by a transition piece. The transition piece is formed substantially parallel to the circuit board and has a bend that separates the contact arms from the contact pins.

19 Claims, 3 Drawing Sheets

ELECTRICAL CONTACT

BACKGROUND OF THE INVENTION

The invention relates to an electrical contact and, more particularly, to an electrical contact that is mounted on a circuit board and receives a contact blade.

DESCRIPTION OF THE PRIOR ART

An electrical contact that is mounted on a circuit board and receives a contact blade is disclosed in U.S. Pat. No. 6,210,240 B1. The contact has a frame with a substantially rectangular cross-section. Contact pins extend from opposing side walls of the frame and contact a circuit board. On a side opposite from the contact pins, contact arms extend from the frame. The contact arms have free ends bent toward the contact pins and positioned inside the frame.

The disadvantage of the above-described contact configuration is that the force exerted on the contact arms by the contact blade can not be easily supported. Further, in systems subject to high levels of vibration, the vibration easily transmits through the contact arms to the contact pins adversely affecting the contact pins electrical connection with the circuit board.

It is therefore desirable to develop an electrical contact that can support the force exerted on the contact arms by the contact blade and is suitable for systems exposed to high levels of vibration.

SUMMARY OF THE INVENTION

This and other objects are achieved by an electrical contact having a contact blade and contact pins for contacting a circuit board. The contact pins are connected to the contact arms by a transition piece. The transition piece is formed substantially parallel to the circuit board and has a bend that separates the contact arms from the contact pins.

DETAILED DESCRIPTION OF THE PREFERRED EMBODIMENT

Figure 5:
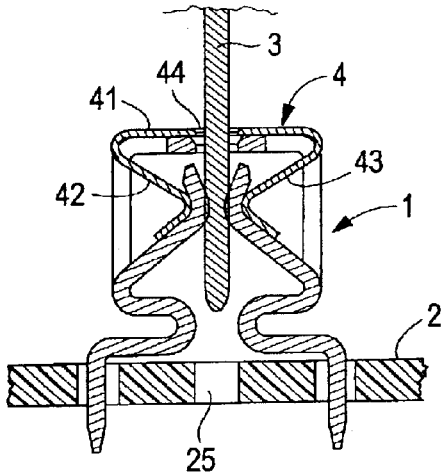
FIG. 5 is a cross-sectional view of the electrical contact mounted on the circuit board with a supporting spring and a contact blade.

FIGS. 1–9 show an electrical contact 1 that is mounted on a circuit board 2 and receives a contact blade 3. The contact is of one-piece construction and is made by stamping and bending a metal sheet. As shown in FIGS. 1–4 and 8, the contact 1 has three pairs of opposing contact pins 13, 14 and three pairs of opposing contact arms 11, 12. The contact pins 13, 14 may also be surface mounted device (SMD) contacts. Each of the contact arms 11, 12 has a free end that extends away from the contact pins 13, 14. As shown in FIG. 5, the free ends extend upward and substantially converge to form a funnel-shaped opening for insertion of the contact blade 3.

Lateral frames 19 having a substantially rectangular cross-section flank the contact arms 11, 12. An upper frame 20 connects the lateral frames 19. The upper frame 20 has a slot 21 for insertion of the contact blade 3 adjacent to the opening formed by the free ends of the contact arms 11, 12. The lateral frames 19 and the upper frame 20 stabilise the contact 1. The lateral frames 19 may additionally be formed for engagement with a tool.

Figure 1:
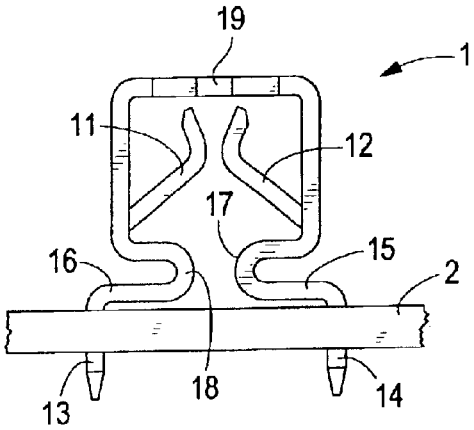
FIG. 1 is a side view of an electrical contact mounted on a circuit board.
Figure 2:
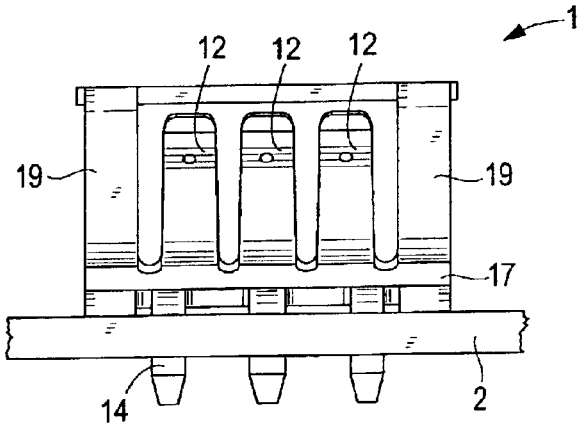
FIG. 2 is a front view of the electrical contact mounted on the circuit board.
Figure 3:
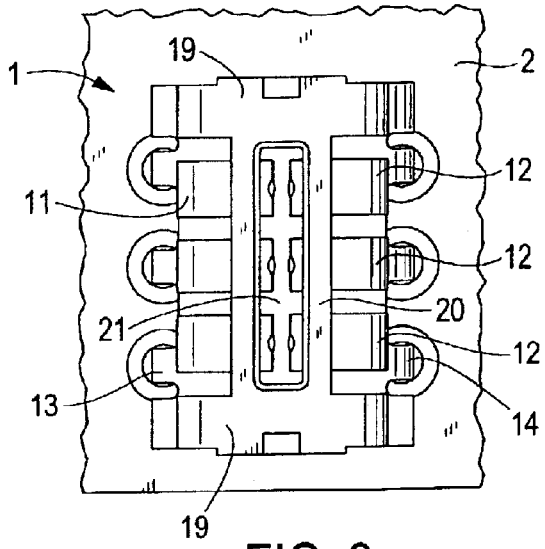
FIG. 3 is a top view of the electrical contact mounted on the circuit board.
Figure 4:
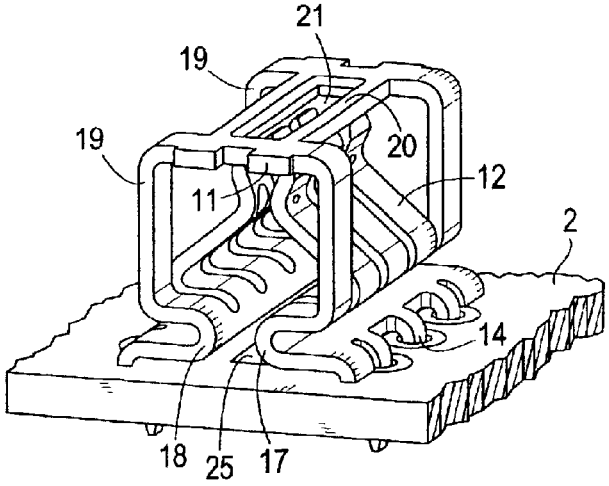
FIG. 4 is a perspective view of the electrical contact mounted on the circuit board.

As most clearly shown in FIG. 1, the contact pins 13, 14 are connected to the lateral frame 19 and the contact arms 11, 12 by opposing transition pieces 15, 16. The transition pieces 15, 16 are formed substantially parallel to the circuit board 2 and have a substantial U-shape with mutually opposing bends 17, 18. The bends 17, 18 mechanically separate the contact pins 13, 14 from the contact arms 11, 12 and the lateral frame 19. As most clearly shown in FIG. 7, spacers 22 may be provided on the contact 1 to define the spacing of the contact 1 relative to the circuit board 2.

Figure 6:
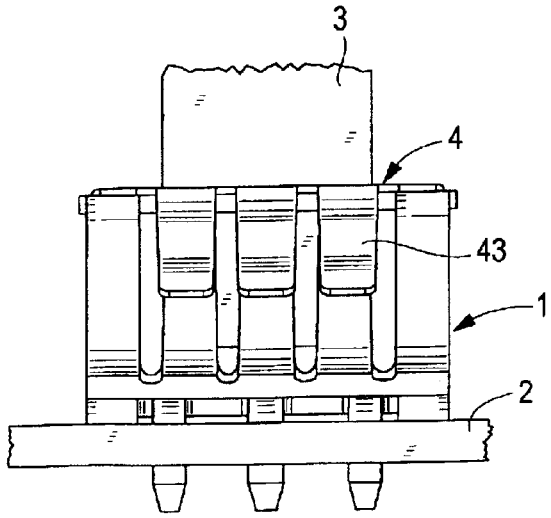
FIG. 6 is a side view of the electrical contact mounted on the circuit board with the supporting spring and the contact blade.
Figure 7:
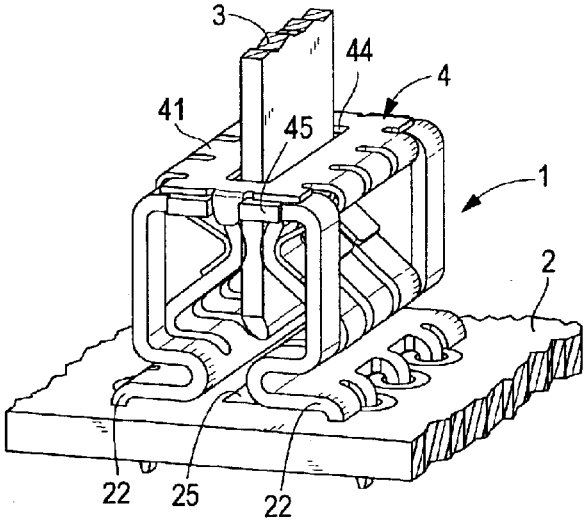
FIG. 7 is a perspective view of the electrical contact mounted on the circuit board with the supporting spring and the contact blade.
Figure 8:
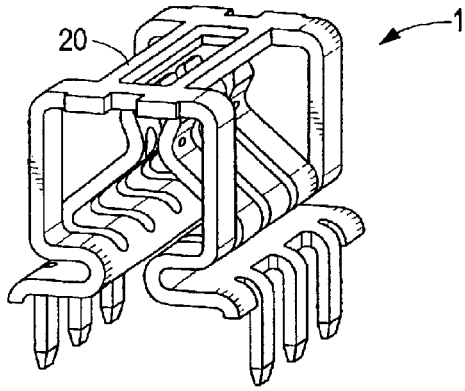
FIG. 8 is a perspective view of the electrical contact.

The contact 1 may have a supporting spring 4, as shown in FIGS. 5–7, depending on the desired strength of the contact 1 to contact force. The supporting spring 4 is mounted on the contact 1 on a side remote from the circuit board 2 and is made from a resilient steel by stamping and bending. The supporting spring 4 has a base 41. The base 41 is positioned adjacent to the upper frame 21 and has a recess 44 adjacent to the opening formed by the free ends of the contact arms 11, 12 for guiding the contact blade 3. Contact supporting arms 42, 43 extend from opposing sides of the base 41 such that the contact supporting arms 42, 43 press on the contact arms 11, 12 and thereby support the contact arms 11, 12. Lugs 45 extend from other opposing sides of the base 41 to attach the supporting spring 4 to the contact 1.

As shown in FIGS. 1–7, the contact 1 may be mounted on a circuit board 2 by pressing the contact pins 13, 14 of the contact 1 into corresponding holes in the circuit board 2. The holes may be plated therethrough. If the contact pins 13, 14 are alternatively SMD contacts, then the SMD contacts may be mounted to the circuit board 2 by known surface mount technology (SMT). The circuit board 2 may comprise a slot 25 corresponding to the opening formed by the free ends of the contact arms 11, 12 to enable the contact blade 3 to be inserted from beneath the circuit board 2 and into the contact 1.

Figure 9:
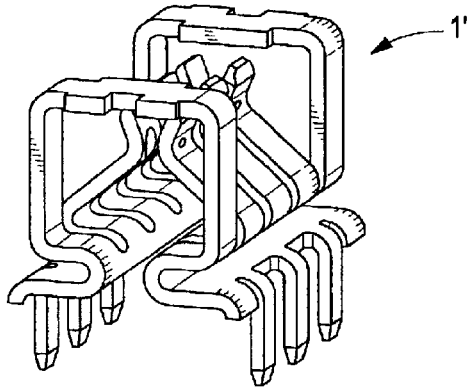
FIG. 9 is a perspective view of another embodiment of the electrical contact.

FIG. 9 shows another embodiment of the contact 1. Contact 1' has the same configuration as the contact 1, except contact 1' does not have the upper frame 20. The contact 1' is preferably used in conjunction with the supporting spring 4 to maintain stability.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

We claim:

1. An electrical contact for receiving a corresponding contact blade, comprising:

contact arms for contacting the contact blade;

lateral frames having substantially rectangular cross-sections, the lateral frames flank the contact arms; and, contact pins for contacting a circuit board, the contact pins connected to the contact arms by a transition piece, the transition piece formed substantially parallel to the circuit board and having a bend that separates the contact arms from the contact pins.

2. The electrical contact of claim 1, wherein the electrical contact is of one-piece construction.

3. The electrical contact of claim 1, wherein the contact arms have free ends that extend away from the contact pins and converge to form an opening for receipt of the contact blade.

4. The electrical contact of claim 1, further comprising an upper frame that connects the lateral frames.

5. The electrical contact of claim 4, wherein the upper frame has a slot for receipt of the contact blade.

6. The electrical contact of claim 1, wherein the lateral frames are connected to the transitional piece.

7. The electrical contact of claim 1, further comprising spacers for positioning the electrical contact relative to the circuit board.

8. The electrical contact of claim 1, further comprising a supporting spring, the supporting spring having a base and contact supporting arms, the contact supporting anus extend from the base adjacent to the contact arms to support the contact arms.

9. The electrical contact of claim 8, further comprising lugs that attach the supporting spring to the electrical contact.

10. The electrical contact of claim 1, wherein the transition piece is substantially U-shaped.

11. An electrical contact for receiving a corresponding contact blade, comprising:

contact arms for contacting the contact blade;

a lateral flame attached to the contact arms and having a substantially rectangular cross-section; and contact pins for contacting a circuit board, the contact pins connected to the contact arms by a transition piece, the transition piece formed substantially parallel to the circuit board and having a bend that separates the contact arms from the contact pins.

12. The electrical contact of claim 11, wherein the electrical contact is of one-piece construction.

13. The electrical contact of claim 11, wherein the contact anus have free ends that extend away from the contact pins and converge to form an opening for receipt of the contact blade.

14. The electrical contact of claim 11, further comprising an upper frame that connects sides of the frame, the upper frame having a slot for receipt of the contact blade.

15. The electrical contact of claim 11, wherein the lateral frame is connected to the contact arms through the transitional piece.

16. The electrical contact of claim 11, further comprising spacers for positioning the electrical contact relative to the circuit board.

17. The electrical contact of claim 11, further comprising a supporting spring, the supporting spring having a base and contact supporting arms, the contact supporting arms extend from the base adjacent to the contact arms to support the contact arms.

18. The electrical contact of claim 17, further comprising lugs that attach the supporting spring to the electrical contact.

19. The electrical contact of claim 17, wherein the base is supported by the lateral frame.

* * * * *